US005377424A

United States Patent [19]

Albanes

[11] Patent Number: 5,377,424

[45] Date of Patent: Jan. 3, 1995

[54] BODY DRYING SYSTEM

[76] Inventor: Leandro R. Albanes, 605 W. Madison, Tower III/ 2907, Chicago, Ill. 60661

[21] Appl. No.: 137,404

[22] Filed: Oct. 18, 1993

[51] Int. Cl.[6] ..... F26B 19/00

[52] U.S. Cl. ..... 34/90; 34/618; 34/619; 34/233; 392/381

[58] Field of Search ..... 34/90, 91, 151, 233, 34/96, 97, 98, 239, 618, 619, 621; 392/370, 380, 381, 382

[56] References Cited

U.S. PATENT DOCUMENTS

| | | | |
|---|---|---|---|
| 2,528,650 | 11/1950 | Graham | 219/39 |
| 2,668,368 | 2/1954 | Jacobs | 34/151 |
| 2,977,455 | 3/1961 | Murphy | 219/39 |
| 3,449,838 | 6/1969 | Chancellor, Jr. | 34/90 |
| 3,621,199 | 11/1971 | Goldstein | 392/370 |
| 3,878,621 | 4/1975 | Duerre | 34/90 |
| 4,094,076 | 6/1978 | Baslow | 34/90 |
| 4,117,309 | 9/1978 | Cayley | 34/151 |
| 4,558,526 | 12/1985 | Baus | 34/232 |
| 4,594,797 | 6/1986 | Houck, Jr. | 34/233 |
| 4,684,787 | 8/1987 | Bunting | 34/151 |
| 4,685,222 | 8/1987 | Houck, Jr. | 34/233 |
| 4,756,094 | 7/1988 | Houck, Jr. | 34/233 |
| 4,780,595 | 10/1988 | Alban | 392/370 |
| 4,856,206 | 8/1989 | Klein | 34/151 |
| 4,875,592 | 10/1989 | Waller | 34/151 |

*Primary Examiner*—Denise L. Gromada
*Attorney, Agent, or Firm*—Hugh E. Smith

[57] ABSTRACT

A body drying system is disclosed for drying the entire body of a user, or alternatively, the towel or robe of a user. The body drying system of this invention includes a rectangular housing with apertures formed within its forward face. The apertures are designed to allow for the passage of warmed air. The housing is specifically dimensioned to fit between a towel rack and the wall onto which the rack is mounted. Thus, the operator may stand in front of the apertures of the housing in order to dry himself or herself. Alternatively, the operator may hang a towel or robe on the rack in front of the apertures. Controls are provided for selecting the degree of heating, the starting time, and the stopping time of the drying system.

4 Claims, 4 Drawing Sheets

BODY DRYING SYSTEM

BACKGROUND OF THE INVENTION

1. Field of the Invention

The present invention relates to a body drying system and more particularly pertains to dryer which may be positioned between a towel rack and a wall for drying a towel and/or the user's body.

2. Description of the Prior Art

The use of body dryers is known in the prior art. More specifically, dryers heretofore devised and utilized for the purpose of drying off a person's body are known to consist basically of familiar, expected and obvious structural configurations, notwithstanding the myriad of designs encompassed by the crowded prior art which have been developed for the fulfillment of countless objectives and requirements.

For instance, U.S. Pat. No. 5,007,182 illustrates a body dryer which includes a platform for supporting the feet of the user. Another patent of interest is U.S. Pat. No. 4,871,900. This patent illustrates a body air dryer which includes a hot air dryer suspended from a ceiling and a flexible skirt which forms a cylinder surrounding the user. Yet another patent of interest is U.S. Pat. No. 3,621,199 which illustrates a body drying apparatus. The apparatus includes a duct for hot air having an outlet and a deflector arranged to deflect a stream of hot air issuing from the outlet.

In this respect, the body drying system according to the present invention substantially departs from the conventional concepts and designs of the prior art, and in so doing provides an apparatus primarily developed for the purpose of drying the body of a user or drying the towel or robe of the user. Furthermore, the present invention provides for a body drying apparatus specifically adapted to be received between a towel rack and the wall onto which the rack is mounted.

Therefore, it can be appreciated that there exists a continuing need for new and improved heaters which can be for drying a person or, in the alternative the persons towel or robe. In this regard, the present invention substantially fulfills this need.

SUMMARY OF THE INVENTION

In view of the foregoing disadvantages inherent in the known types of dryers now present in the prior art, the present invention provides an improved dryer construction wherein the same can be utilized for drying towels, robes, or the body of a person. As such, the general purpose of the present invention, which will be described subsequently in greater detail, is to provide a new and improved body drying system apparatus and method which has all the advantages of the prior art dryers and none of the disadvantages.

To attain this, the present invention essentially comprises a body drying system for blow drying the entire body of an individual after bathing comprising a towel rack mountable on the wall of a bath room with a horizontal towel supporting rail; a substantially rectangular housing halving a forward face, a rearward face, an upper surface and a lower surface, three oblong apertures horizontally oriented within the forward face, the rectangular housing dimensioned to be received between the towel rack and the bathroom wall onto which the rack is mounted; a set of louvers positioned within each of the apertures of the housing, the louvers of each set of louvers being horizontally oriented and pivotally mounted about horizontal axes for directing air in an intended direction; a heating element positioned within the housing adjacent the forward face for heating air passing there adjacent; a blower positioned within the housing intermediate the rearward face and the heating element, the blower adapted to direct air towards and through the apertures of the housing; a timing mechanism positioned within the forward face of the housing, the timing mechanism operatively coupled to both the heating element and the blower to effect their activation and inactivation; and a temperature control switch positioned within the forward face of the housing, the switch having settings corresponding to low, medium and high, the temperature control switch operatively coupled to the heating element. The rail may be located at an elevation beneath the upper surface or at another location so to allow a supported towel to depend to a location adjacent to the louvers.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved body drying system which has all the advantages of the prior art body drying systems and none of the disadvantages.

It is another object of the present invention to provide a new and improved body drying system which may be easily and efficiently manufactured and marketed.

It is a further object of the present invention to provide a new and improved body drying system which is of a durable and reliable construction.

An even further object of the present invention is to provide a new and improved body drying system which is susceptible of a low cost of manufacture with regard to both materials and labor, and which accordingly is then susceptible of low prices of sale to the consuming public, thereby making such body drying systems economically available to the buying public.

Still yet another object of the present invention is to dry a user after a bath or shower which provides in the apparatuses and methods of the prior art some of the advantages thereof, while simultaneously overcoming some of the disadvantages normally associated therewith.

Still another object of the present invention is to provide a new and improved body drying system.

Yet another object of the present invention is to dry a towel or bath robe of a user.

Even still another object of the present invention is to provide comforting warmth to a person after a bath or shower.

Lastly, it is an object of the present invention to provide a body drying system for blow drying and the entire body of an individual after bathing comprising a towel rack mountable on the wall of a bath room with a horizontal towel supporting rail; a substantially rectangular housing having a forward face, a rearward face, an upper surface and a lower surface, three oblong apertures horizontally oriented within the forward face, the rectangular housing dimensioned to be received between the towel rack and the bathroom wall onto which the rack is mounted; a set of louvers positioned within each of the apertures of the housing, the louvers of each set of louvers being horizontally oriented and pivotally mounted about horizontal axes for directing air in an intended direction; a heating element positioned within the housing adjacent the forward face for heating air passing thereadjacent; a blower positioned within the housing intermediate the rearward face and the heating element, the blower adapted to direct air towards and through the apertures of the housing; a timing mechanism positioned within the forward face of the housing, the timing mechanism operatively coupled to both the heating element and the blower to effect their activation and inactivation; and a temperature control switch positioned within the forward face of the housing, the switch having settings corresponding to low, medium and high, the temperature control switch operatively coupled to the heating element.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
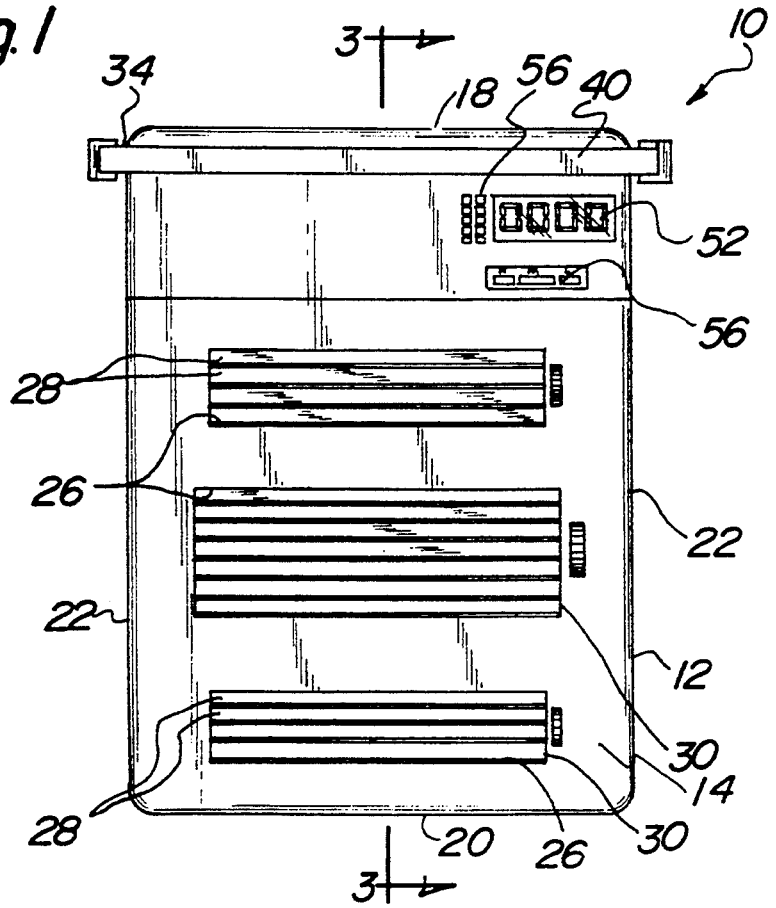
FIG. 1 is a front elevational view of a body drying system constructed in accordance with the principals of the present invention.
Figure 2:
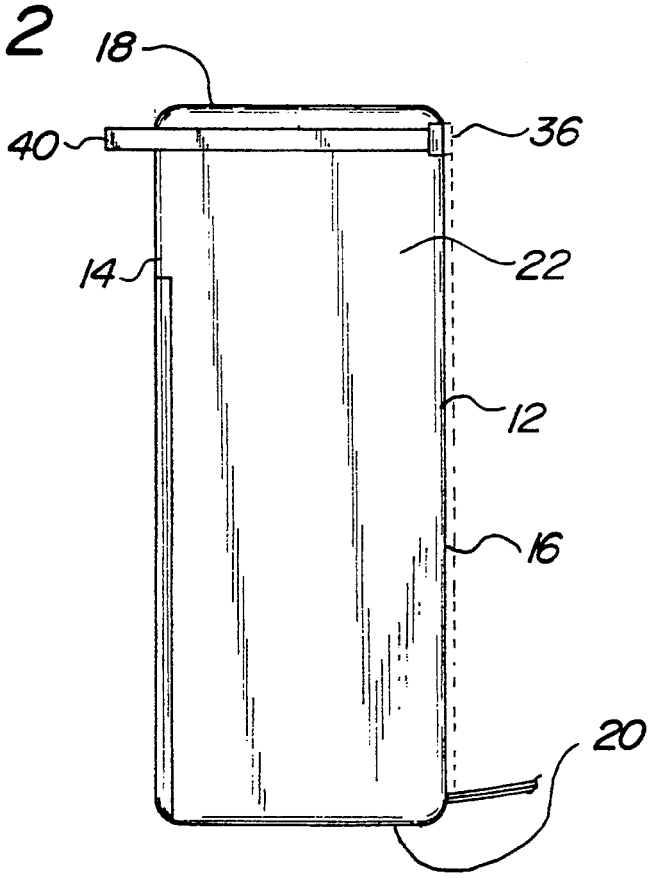
FIG. 2 is a side elevational view of a body drying system as shown in FIG. 1.
Figure 3:
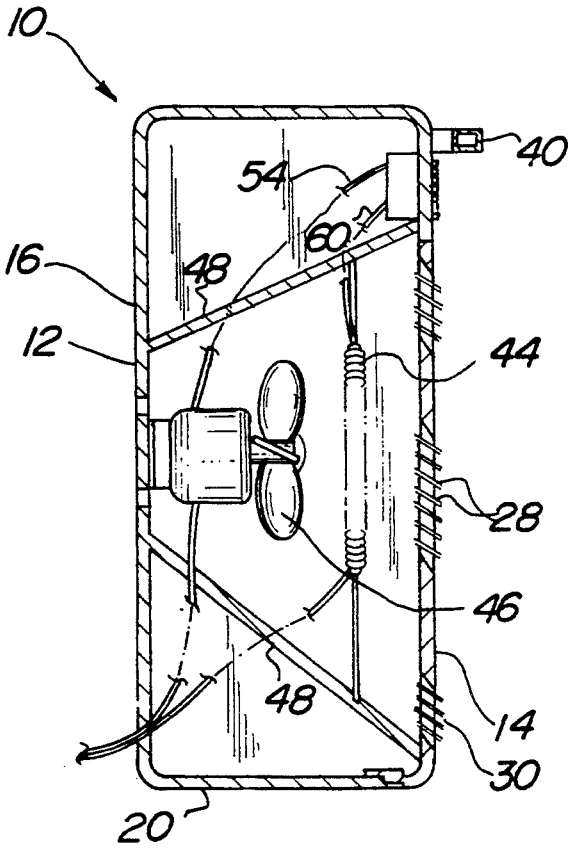
FIG. 3 is a sectional view taken along line 3—3 of FIG. 1.
Figure 4:
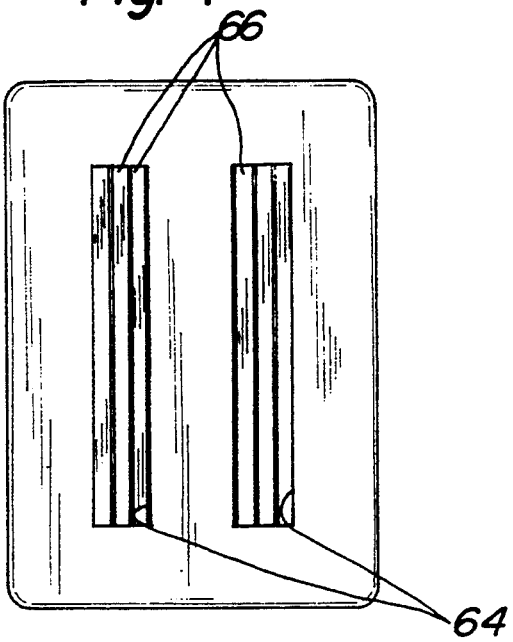
FIG. 4 is a body drying system similar to that of the prior Figures but illustrating the louvers in an alternate orientation.
Figure 5:
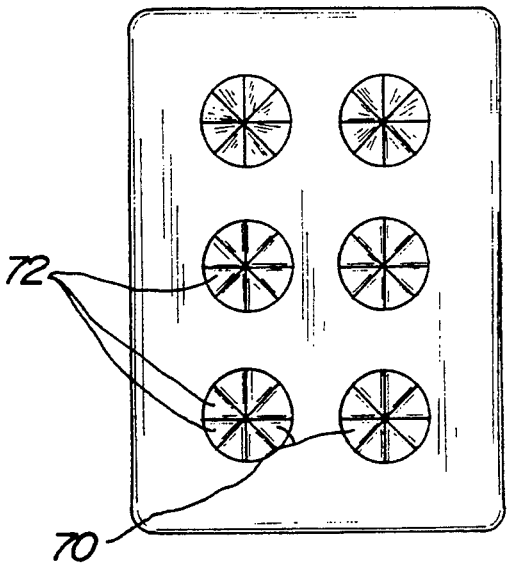
FIG. 5 is a front view of the device similar of that of the prior Figures but illustrating the louvers in an additional orientation.

With reference now to the drawings, and in particular to FIG. 1 thereof, a new and improved body drying system embodying the principles and concepts of the present invention and generally designated by the reference numeral 10 will be described.

The present invention relates to a body drying system 10 blow drying the entire body of an individual after bathing or for drying the user's towel and/or robe. The system includes a substantially rectangular housing 12 having a forward face 14, a rearward face 16, an upper surface 18 and a lower surface 20 and side faces 22. In the first and prefered embodiment of the invention, three rectangular oblong apertures 26 are horizontally oriented within the forward face 14 of the housing. Within each of the oblong apertures is a number of louver elements 28, with the louver elements within each of the apertures serving to define a set 30. Each set of louvers is horizontally oriented with the louver elements pivotally mounted about parallel horizontal axes. Apertures are formed in the rearward face to facilitate the flow if air through the housing and to prevent overheating.

The overall rectangular housing 12 is dimensioned and designed to fit between a towel rack 34 and the wall 36 on which the rack is mounted. The rack has a towel supporting rail 40 secured to the wall 36 at an elevation beneath the upper surface 18 and spaced from the wall 36 and receive the housing 12 therebetween. The rail 40 could be higher so long as a towel may depend therefrom to be situated in front of the apertures 26 for drying purposes.

There are a number components positioned within the interior of the housing. The first component is a heating element 44. The heating element is positioned within the housing adjacent its forward face 14. The second component is the blower 46. The blower is positioned within the housing intermediate the rearward face 16 and the heating element 44. The blower is designed to direct air towards the apertures 26 of the housing. Thus, as is standard in such heating devices, the air directed from the blower 46 is warmed by its travel around the heating element 44, and then exits by way of the apertures 26 in the housing.

The housing and the apertures are dimensioned and proportioned such that the air from the blower generates a positive pressure build up within the housing before exiting. In this situation the housing acts as a plenum to force the air from the apertures. Outwardly flared walls 48 assist in this function.

There are a number of elements positioned on the forward face 14 of the housing. The first element is a timing mechanism 52. The timing mechanism is operatively coupled by lines 54 to both the blower 46 and the heating element 44. The timing mechanism 52 serves to regulate the stopping time and/or the starting time of the blower and the heating element. The timing mechanism 52 includes a time setting device 56. The time setting device may take the form of an analog dial or a digital keypad. In either form, the setting device is used by the operator of the blow drying system to regulate its stopping time and or its starting time.

The second element positioned on the forward face of the housing is a temperature control switch 58. The temperature control switch 58 is operatively coupled by lines 60 to the heating element 44. The switch includes bottoms for settings corresponding to low, medium and high heat.

In the second embodiment, the three oblong apertures 26 formed within the forward face 16 of the housing are replaced by two rectangular vertically oriented apertures 64. Furthermore, the louver sets of the first embodiment are replaced by louver sets which are formed from a number of vertically oriented louver elements 66 pivotally mounted about a vertical axis. Thus, the air flow from any one of the apertures can be directed about the vertical axis.

In the third embodiment of the device, the oblong apertures formed within the forward face of the housing are replaced by six circular apertures 70. The circular apertures are positioned in two columns of three apertures. Furthermore, the louver sets of the first embodiment are replaced by louver sets which are formed from a number of louver elements 72 extending radially outward from the center of each of the circular apertures. In the second embodiment, each set of louvers is rotatively coupled to one of the circular apertures. Thus, the air flow from any one of the apertures can be directed about a 360 degree angle.

Figure 6:
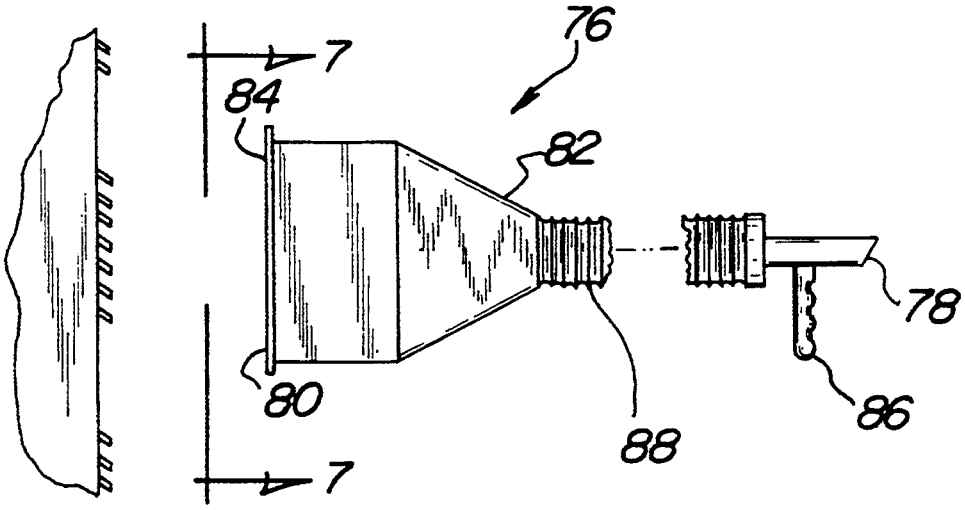
FIG. 6 show an alternate embodiment of the invention wherein a hand held device for directing heated air may be held in the hand of a user.
Figure 7:
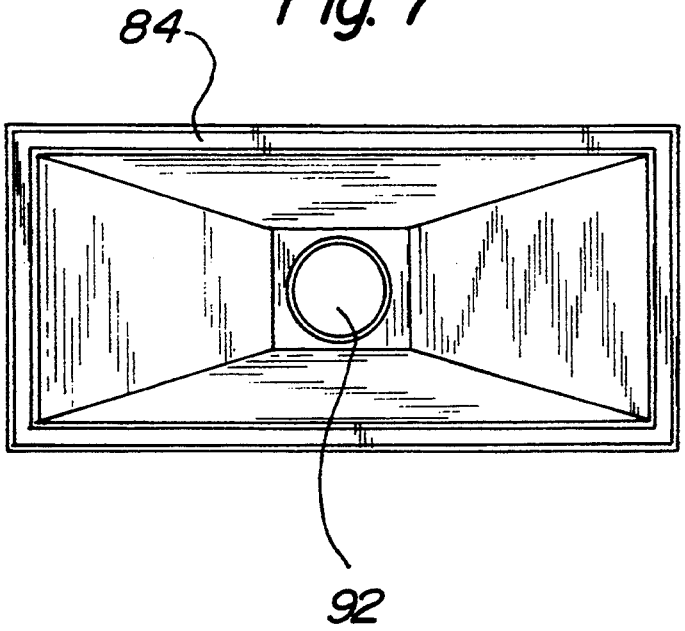
FIG. 7 is an end view of the apparatus shown in FIG. 6 taken along line 7—7 of FIG. 6.

Shown in FIGS. 6 and 7 is an alternate embodiment of the invention featuring a hand held nozzle attachment 76. The nozzle attachment has a forward 78 and a rearward end 80. It is adapted to be removable coupled to one of the apertures of the forward base of the housing of any other prior embodiments. A tapered air deflector 82 is at the rearward end 80 of the attachment coupled with respect thereto is a magnetic flange 84 for coupling the rearward end 80 to the forward base of the housing. The magnetic flange is preferably located around the periphery at the rearward end of the air deflector. At the forward end of the nozzle attachment is a handle 86. A flexible hose 88 is centrally located between the forward and rearward ends to allow the directing of the flow of air in any direction as determined by the user holding the handle 86. A central aperture 92 extends the entire distance between the forward and rearward ends of the nozzle attachment.

Figure 8:
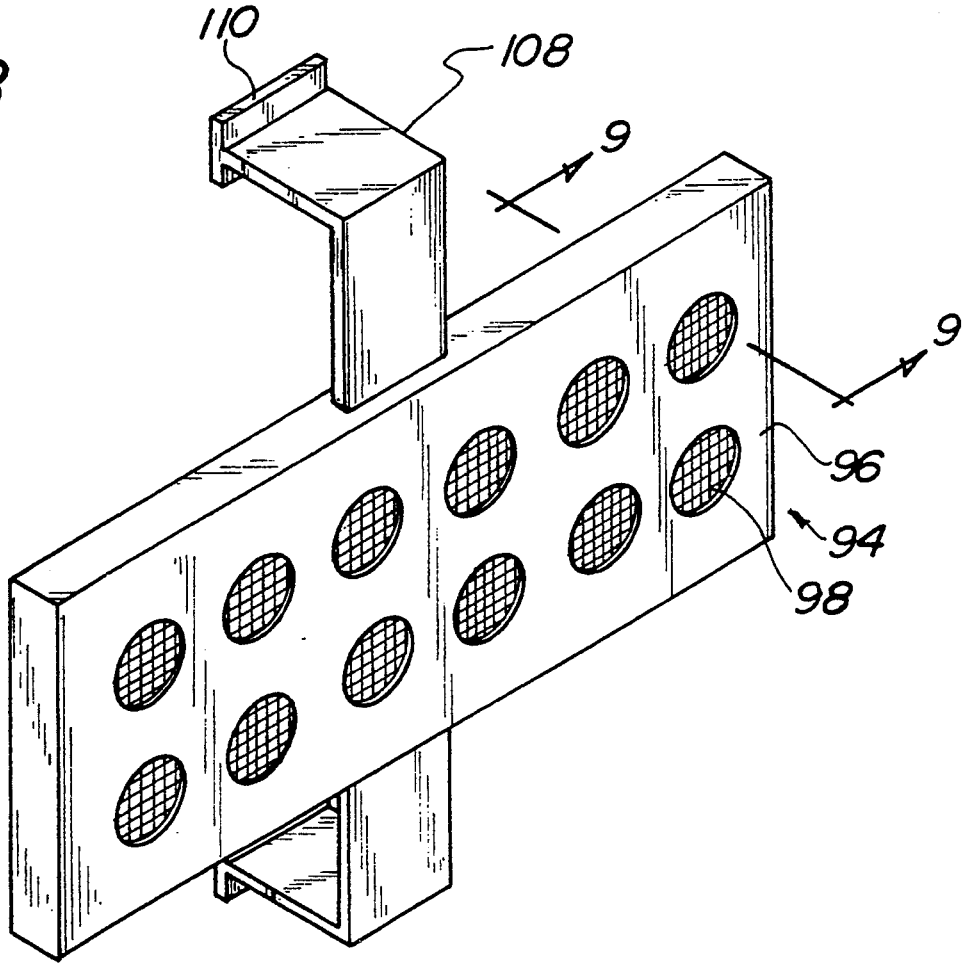
FIG. 8 is an perspective illustration of yet an alternate embodiment of the invention for dispensing freshened air.
Figure 9:
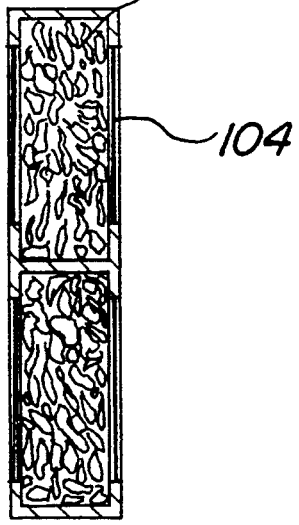
FIG. 9 is a sectional view taken along line 9—9 of FIG. 8.

FIGS. 8 and 9 show yet a further alternate embodiment of the invention. According to the FIG. 8 embodiment, an air freshening attachment 94 is capable of being utilized. The air freshening attachment is removable coupled adjacent to one of the apertures of the hounding. The attachment has a central chamber with apertures 98 on the front and rear face thereof. An air freshening material 102 is located between the walls of the housing 96. A screen or mesh 104 covers the apertures 98 to retain the air freshening material in location. A bracket 108 is secured with respect to the housing and includes magnets 110 at its rearward faces for magnetic securement with respect to the forward face of the housing adjacent to a set of louvers. In this manner, warm air from the system may be directed through the housing 96 for being scented by the air freshening material 102 through which it passes.

In use, the housing is placed within a bathroom specifically, within the space defined by a wall and a towel rack mounted upon the wall. Thus, a robe or towel which is placed upon the towel rack can receive the warmed air supplied by the blow drying system of the present invention. Furthermore, a start time and stop time can be set by way of the timing mechanism and the time setting device. This can be done in such a manner that the operator of the system can wake up to or step out of the shower to a warm robe or towel. In use as a body dryer, an operator stepping out of the shower can turn the device on and stand in front of the apertures in order to dry his or her body. If desired, the operator can select a start time and or a stop time to facilitate his or her drying.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A body drying system for blow drying the entire body of an individual after bathing comprising:

a substantially rectangular housing having a forward face, a rearward face, an upper surface and a lower surface, a plurality of apertures formed within the forward face, the plurality of apertures being six circular apertures positioned in two columns and wherein each set of louvers is a plurality comprised of louver elements which extend radially outward from the center of each of the circular apertures, each set of louvers being rotatively coupled to one of the circular apertures, the rectangular housing dimensioned to be received with its forward face adjacent to a towel rack and its rearward face adjacent to a bathroom wall onto which the rack is mounted;

a set of louvers positioned within each of the apertures of the housing;

a heating element positioned within the housing adjacent the forward face;

a blower positioned within the housing intermediate the rearward face and the heating element, the blower serving to direct air towards the apertures of the housing;

a timing mechanism positioned within the forward face of the housing, the timing mechanism operatively coupled to both the heating element and the blower; and a temperature control switch positioned within the forward face of the housing, the switch having settings corresponding to low, medium and high, the temperature control switch operatively coupled to the heating element.

2. The body drying system of claim 1 and further including:

a hand held nozzle attachment adapted to be removably coupled to one of the apertures of the forward face of the housing, the nozzle attachment having a forward end and a rearward end;

a tapered air deflector having a forward end and a rearward end, the tapered air deflector defining the rearward end of the hand held nozzle attachment;

a magnetic flange adapted to be sealingly secured about one of the apertures of the forward face of the housing, the magnetic flange defining the rearward end of the tapered air deflector; and an air outlet portion having a forward end with a handle and a rearward end with a flexible base therebetween the rearward end of the outlet portion being attached to the forward end of the tapered air deflector, the air outlet defining the forward end of the hand held nozzle attachment.

3. The body drying system of claim 1 and further including:

an air freshening attachment adapted to be removably coupled to one of the apertures of the forward face of the housing, the attachment having a central chamber for the receipt of a fragrant material, the attachment also having holes for the passage of air through the attachment and fragrant material; and a magnetic element secured to the attachment for removably coupling the attachment to the forward face adjacent to an aperture.

4. A body drying system for blow drying the entire body of an individual after bathing comprising:

a substantially rectangular housing having a forward face, a rearward face, an upper surface and a lower surface, a plurality of apertures formed within the forward face, the plurality of apertures being six circular apertures positioned in two columns and wherein each set of louvers is a plurality comprised of louver elements which extend radially outward from the center of each of the circular apertures, each set of louvers being rotatively coupled to one of the circular apertures, the rectangular housing dimensioned to be received with its forward face adjacent to a towel rack and its rearward face adjacent to a bathroom wall onto which the rack is mounted;

a set of louvers positioned within each of the apertures of the housing;

a heating element positioned within the housing adjacent the forward face;

a blower positioned within the housing intermediate the rearward face and the heating element, the blower serving to direct air towards the apertures of the housing;

a timing mechanism positioned within the forward face of the housing, the timing mechanism operatively coupled to both the heating element and the blower;

a temperature control switch positioned within the forward face of the housing, the switch having settings corresponding to low, medium and high, the temperature control switch operatively coupled to the heating element; and a towel rack, the towel rack having parallel short arms having inner ends secured to the wall and having outer ends with a horizontal bar coupling the outer ends of the arms, the towel rack being positioned wherein the upper extent of the housing is located between the arms, bar and wall.

* * * * *